US005509831A

United States Patent [19]

Gelbart

[11] Patent Number: 5,509,831

[45] Date of Patent: Apr. 23, 1996

[54] UNICYCLE FOR OPERATION IN WATER

[76] Inventor: Ida Gelbart, 64 Heritage Dr., San Rafael, Calif. 94901

[21] Appl. No.: 514,585

[22] Filed: Aug. 14, 1995

[51] Int. Cl.[6] ..... B63H 16/20

[52] U.S. Cl. ..... 440/27

[58] Field of Search ..... 440/21, 26, 27; 441/130; 482/58, 111; 472/128, 129; 280/205

[56] References Cited

U.S. PATENT DOCUMENTS 2,317,905 4/1943 Galkin ..... 440/26
4,241,688 12/1980 Mansolill et al. ..... 440/26

FOREIGN PATENT DOCUMENTS 2272412 5/1994 United Kingdom ..... 441/130

*Primary Examiner*—Edwin L. Swinehart

[57] ABSTRACT

A unicycle for operation in water comprised of a frame having buoyancy pads disposed therein. The frame has a yoke portion. The yoke portion has a pair of extending arms. A hollow wheel has an intake opening formed through a central portion thereof. The hollow wheel has an impeller mechanism disposed therein. The hollow wheel has an exhaust pipe tangentially integral therewith extending outwardly therefrom. The hollow wheel is positioned between the pair of extending arms of the yoke portion. A pair of pedals rotatably couple the hollow wheel to the pair of extending arms of the yoke through the intake valve opening. A foam padded seat portion is secured to the frame.

6 Claims, 4 Drawing Sheets

UNICYCLE FOR OPERATION IN WATER

BACKGROUND OF THE INVENTION

1. Field of the Invention

The present invention relates to a unicycle for operation in water and more particularly pertains to remaining buoyant and propelling a user forward through water with a unicycle for operation in water.

2. Description of the Prior Art

The use of unicycles is known in the prior art. More specifically, unicycles heretofore devised and utilized for the purpose of exercising and recreating are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,706,157 to Bandy discloses a foot propelled unicycle directed and motivated by body movement of the operator.

U.S. Pat. No. 4,786,067 to Tang discloses a unicycle.

U.S. Pat. No. 4,062,558 to Wasserman discloses a unicycle.

U.S. Pat. Des. No. 273,287 to Evans discloses the ornamental design for a unicycle.

U.S. Pat. No. 4,324,413 to Bensette et al. discloses a unicycle with water balance.

While these devices fulfill their respective, particular objective and requirements, the aforementioned patents do not describe a unicycle for operation in water for remaining buoyant and propelling a user forward through water.

In this respect, the unicycle for operation in water according to the present invention substantially departs from the conventional concepts and designs of the prior art, and in doing so provides an apparatus primarily developed for the purpose of remaining buoyant and propelling a user forward through water.

Therefore, it can be appreciated that there exists a continuing need for new and improved unicycle for operation in water which can be used for remaining buoyant and propelling a user forward through water. In this regard, the present invention substantially fulfills this need.

SUMMARY OF THE INVENTION

In the view of the foregoing disadvantages inherent in the known types of unicycles now present in the prior art, the present invention provides an improved unicycle for operation in water. As such, the general purpose of the present invention, which will be described subsequently in greater detail, is to provide a new and improved unicycle for operation in water and method which has all the advantages of the prior art and none of the disadvantages.

To attain this, the present invention essentially comprises a frame having an upper end and a lower end. The frame has buoyancy pads disposed therein. The lower end has a yoke portion. The yoke portion has a pair of extending arms. The pair of extending arms have aligning apertures formed therethrough. A pair of upper straps are secured to the upper end. Each of the upper straps has hook and loop straps on end portions thereof. The device contains a hollow wheel having an intake opening formed through a central portion thereof. The hollow wheel has an impeller means disposed therein. The hollow wheel has an exhaust pipe tangentially integral therewith extending outwardly therefrom. The hollow wheel is positioned between the pair of extending arms of the yoke portion with the intake opening aligning with the aligning apertures of the pair of extending arms. The device contains an axle rotatably coupling the hollow wheel to the pair of extending arms of the yoke through the aligning intake opening and aligning apertures. The axle has pedals secured to end portions thereof. Each of the pedals has a pair of hook and loop straps thereon for securement around a user's feet. The device contains a foam padded seat portion secured to a platform portion. The platform portion secures to the frame intermediate the upper end and the lower end thereof. The foam padded seat portion has a pair of hook and loop straps thereon for securement around a user's lap when seated on the foam padded seat portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved unicycle for operation in water which has all the advantages of the prior art unicycles and none of the disadvantages.

It is another object of the present invention to provide a new and improved unicycle for operation in water which may be easily and efficiently manufactured and marketed.

It is a further object of the present invention to provide a new and improved unicycle for operation in water which is of durable and reliable construction.

An even further object of the present invention is to provide a new and improved unicycle for operation in water which is susceptible of a low cost of manufacture with regard to both materials and labor, and which accordingly is then susceptible of low prices of sale to the consuming public, thereby making such a unicycle for operation in water economically available to the buying public.

Still yet another object of the present invention is to provide a new and improved unicycle for operation in water which provides in the apparatuses and methods of the prior art some of the advantages thereof, while simultaneously overcoming some of the disadvantages normally associated therewith.

Even still another object of the present invention is to provide a new and improved unicycle for operation in water for remaining buoyant and propelling a user forward through water.

Lastly, it is an object of the present invention to provide a new and improved unicycle for operation in water comprised of a frame having buoyancy pads disposed therein. The frame has a yoke portion. The yoke portion has a pair of extending arms. A hollow wheel has an intake opening formed through a central portion thereof. The hollow wheel has an impeller mechanism disposed therein. The hollow wheel has an exhaust pipe tangentially integral therewith extending outwardly therefrom. The hollow wheel is positioned between the pair of extending arms of the yoke portion. A pair of pedals rotatably couple the hollow wheel to the pair of extending arms of the yoke through the intake opening. A foam padded seat portion is secured to the frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
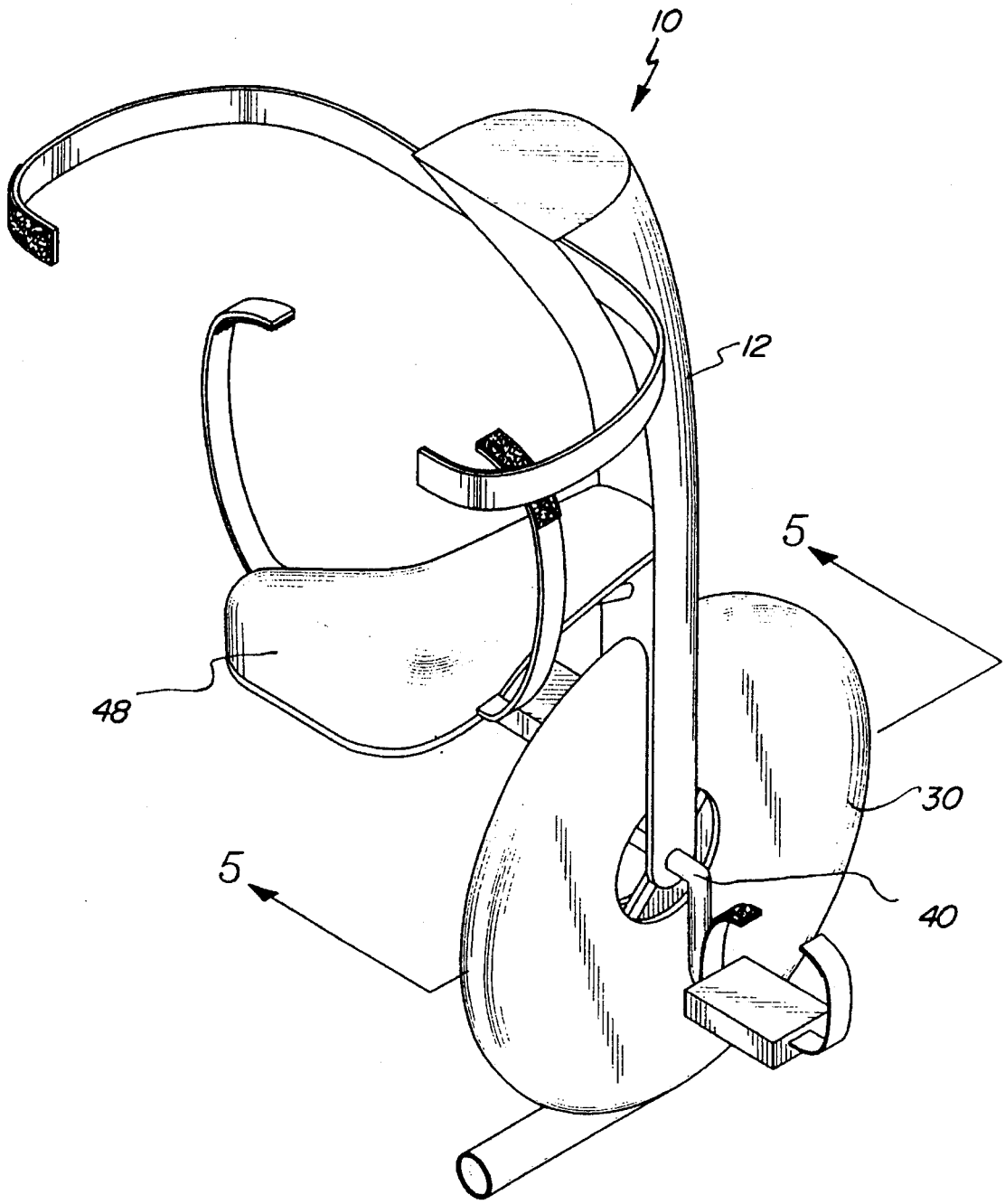
FIG. 1 is a perspective view of the preferred embodiment of the unicycle for operation in water constructed in accordance with the principles of the present invention.
Figure 2:
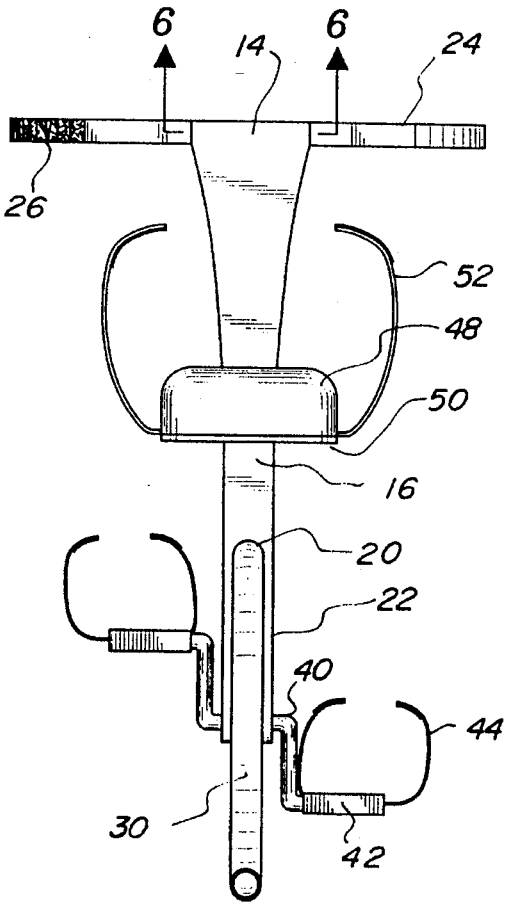
FIG. 2 is a rear elevation view of the present invention.
Figure 3:
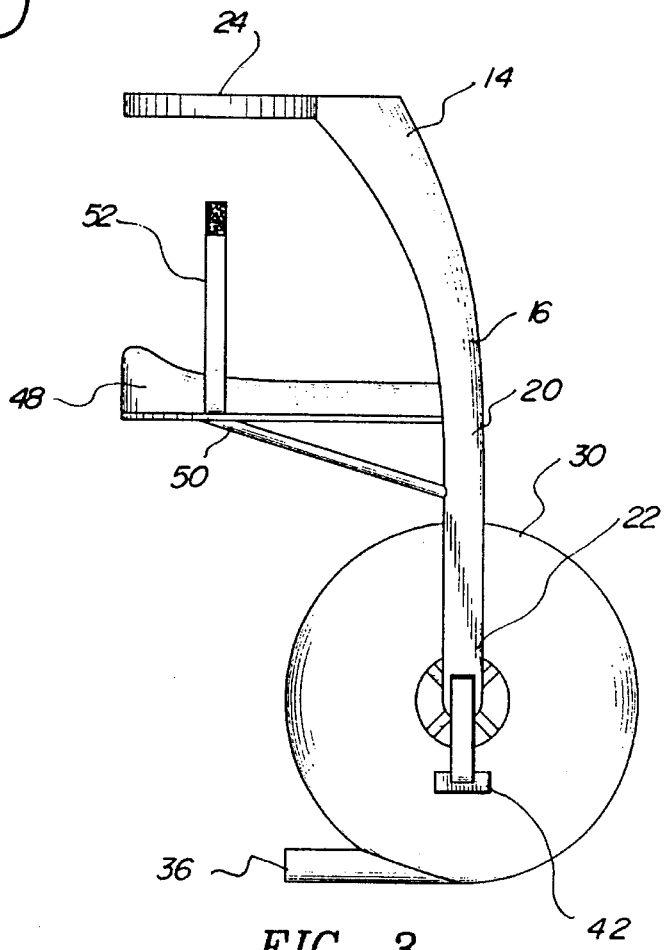
FIG. 3 is a side elevation view of the present invention.
Figure 4:
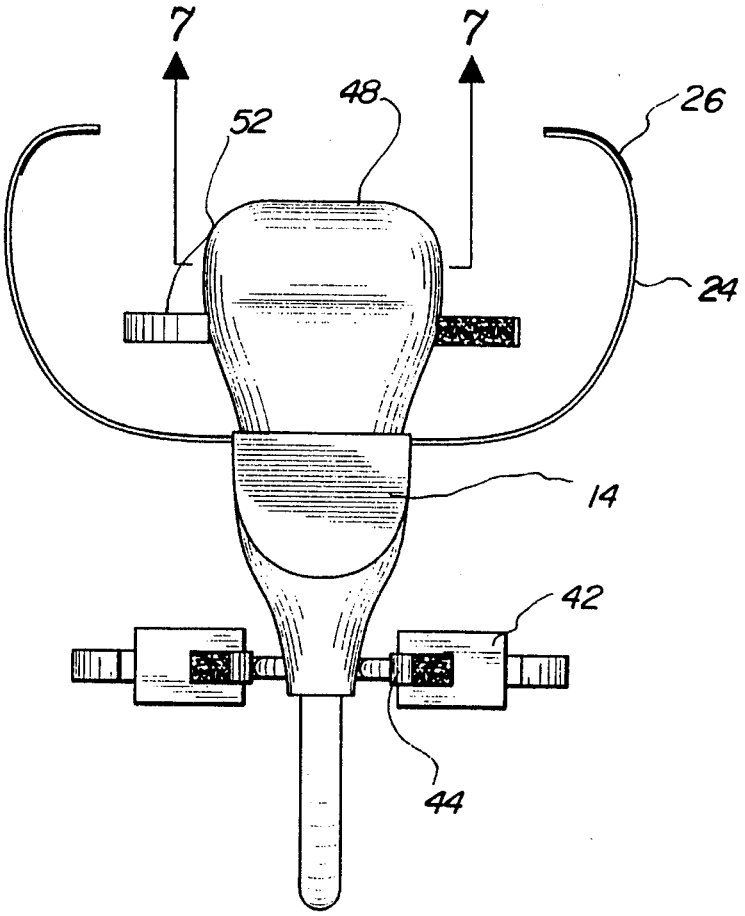
FIG. 4 is a plan view of the preferred embodiment of the present invention.
Figure 5:
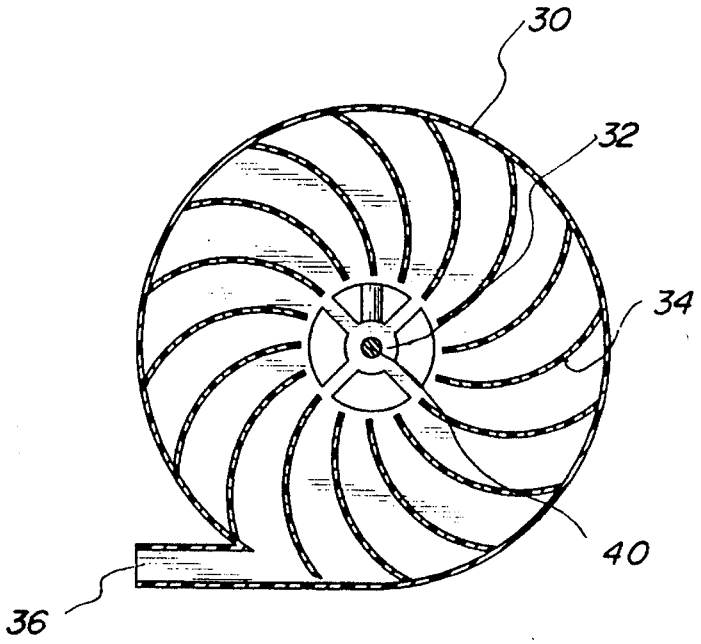
FIG. 5 is a cross-sectional view as taken along line 5—5 of FIG. 1.
Figure 6:
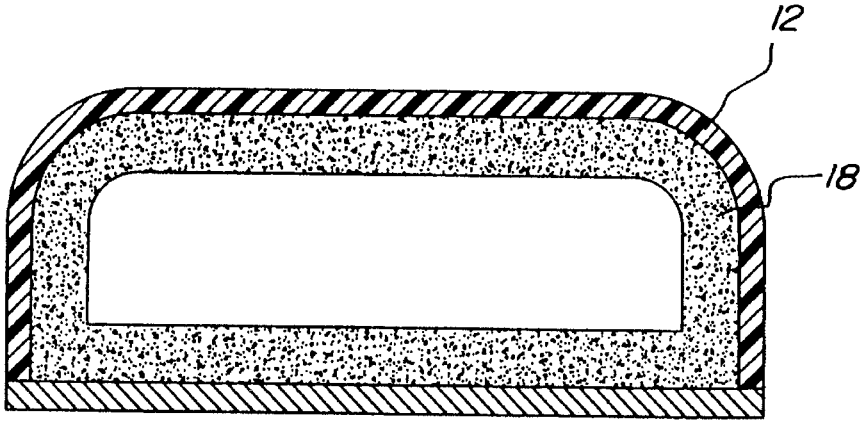
FIG. 6 is a cross-sectional view as taken along line 6—6 of FIG. 2.
Figure 7:
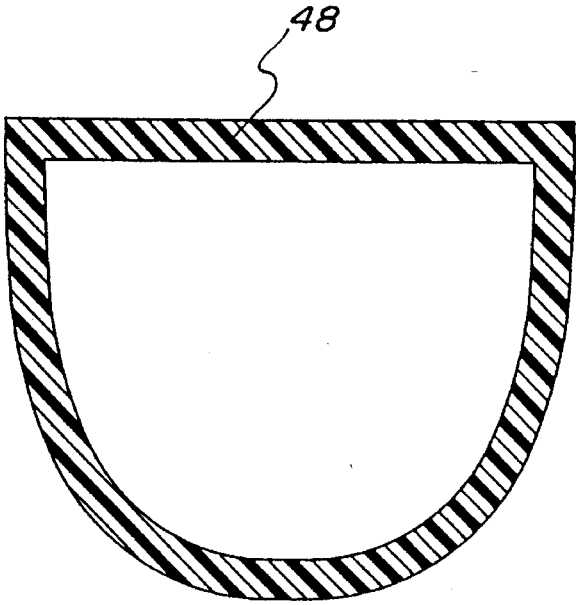
FIG. 7 is a cross-sectional view as taken along line 7—7 of FIG. 4.

With reference now to the drawings, and in particular, to FIGS. 1–7 thereof, the preferred embodiment of the new and improved unicycle for operation in water embodying the principles and concepts of the present invention and generally designated by the reference number 10 will be described.

Specifically, it will be noted in the various Figures that the device relates to a new and improved unicycle for operation in water for remaining buoyant and propelling a user forward through water. In its broadest context, the device consists of a frame, a hollow wheel, an axle, and a foam padded seat. Such components are individually configured and correlated with respect to each other so as to attain the desired objectives.

The device 10 contains a frame 12 having an upper end 14 and a lower end 16. The frame 12 has buoyancy pads 18 disposed therein. The buoyancy pads 18 are comprised of foam or any other floating materials that will aide in keeping the frame 12 afloat. The upper end 14 of the frame 12 is curved inwardly to conform to a user's body. The lower end 16 has a yoke portion 20. The yoke portion 20 has a pair of extending arms 22. The pair of extending arms 22 measure about one-third of the overall length of the frame 12. The pair of extending arms 22 have aligning apertures formed therethrough. A pair of upper straps 24 are secured to the upper end 14. Each of the upper straps 24 has hook and loop straps 26 on end portions thereof. The pair of upper straps 24 are adaptable to secure around a chest of a user when using the device 10. The hook and loop straps 26 are designed to easily release from the user in case of an emergency. The upper end 14 having a diameter greater than twice the diameter of the lower end 16.

The device 10 contains a hollow wheel 30 having an intake valve opening 32 formed through a central portion thereof. The intake opening 32 allows the hollow wheel to fill up with water when placed into a swimming pool or other water filled area. The hollow wheel 30 has an impeller means disposed therein. The impeller means further defining a plurality of curved blades 34. The hollow wheel 30 has an exhaust pipe 36 tangentially integral therewith extending outwardly therefrom. The hollow wheel 30 is positioned between the pair of extending arms 22 of the yoke portion 20 with the intake opening 32 aligning with the aligning apertures of the pair of extending arms 22. When the hollow wheel 30 is rotated, the plurality of curved blades 34 bias water within the wheel 30 outwardly of the exhaust pipe 36 thereby propelling the device 10 and the user forward.

The device 10 contains an axle 40 rotatably coupling the hollow wheel 30 to the pair of extending arms 22 of the yoke 20 through the aligning intake opening 32 and aligning apertures. The axle 40 has pedals 42 secured to end portions thereof. The pedals 42 allow the user to rotate the hollow wheel 30 causing the plurality of curved blades 34 to bias water within the wheel 30 outwardly of the exhaust pipe 36 thereby propelling the device 10 and the user forward. Each of the pedals 42 has a pair of hook and loop straps 44 thereon for securement around a user's feet. The hook and loop straps 44 are designed to easily release from the user in case of an emergency.

The device 10 contains a foam padded seat portion 48 secured to a platform portion 50. The platform portion 50 secures to the frame 12 intermediate the upper end 14 and the lower end 16 thereof. The platform portion 50 could be made to be adjustable to allow for a variety of different sized users to comfortably use the device 10. The foam padded seat portion 48 is designed for comfort and also designed to aid the device in staying afloat. The foam padded seat portion 48 has a pair of hook and loop straps 52 thereon for securement around a user's lap when seated on the foam padded seat portion 48. The hook and loop straps 52 are designed to easily release from the user in case of an emergency.

The device 10 is a specialized unicycle, mechanically adapted to operate efficiently in water. The device 10 is designed to maintain buoyancy and propel the user forward through the water.

The frame 12 of this vehicle is constructed from strong, lightweight plastic or steel. Durable hook and loop straps hold the rider securely in place on the seat 48 and pedals 42. A soft, comfortable seat 48 is adjustable to accommodate various leg lengths, and buoyancy devices are attach to the frame 12 to keep it upright and steady. The wheel 30 is designed to move through the water with minimal resistance, and an intake 32 is located at its center to draw water and then expel it from the connected exhaust pipe 34.

The rider operates the unit like any typical unicycle or bicycle. After mounting the device 10, the user straps themselves to the seat 48 and pedals 42, and pushes with the legs and feet in a rotary fashion. As water is pulled in through the intake 32, the specially designed impeller forces the water downward and through the exhaust pipe 34.

This is an excellent physical therapy tool for those individuals who want to enjoy the vast benefits of aquatic training and conditioning. It can be used as a sport vehicle for water games and as a rescue device by lifeguards to reach victims quickly. Environmentally sound, it requires only human energy.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A unicycle for operation in water for remaining buoyant and propelling a user forward through water comprising, in combination:

a frame having an upper end and a lower end, the frame having buoyancy pads disposed therein, the lower end having a yoke portion, the yoke portion having a pair of extending arms, the pair of extending arms having aligning apertures formed therethrough, a pair of upper straps secured to the upper end, each of the upper straps having hook and loop straps on end portions thereof;

a hollow wheel having an intake opening formed through a central portion thereof, the hollow wheel having an impeller means disposed therein, the hollow wheel having an exhaust pipe tangentially integral therewith extending outwardly therefrom, the hollow wheel positioned between the pair of extending arms of the yoke portion with the intake opening aligning with the aligning apertures of the pair of extending arms;

an axle rotatably coupling the hollow wheel to the pair of extending arms of the yoke through the aligning intake opening and aligning apertures, the axle having pedals secured to end portions thereof, each of the pedals having a pair of hook and loop straps thereon for securement around a user's feet;

a foam padded seat portion secured to a platform portion, the platform portion securing to the frame intermediate the upper end and the lower end thereof, the foam padded seat portion having a pair of hook and loop straps thereon for securement around a user's lap when seated on the foam padded seat portion.

2. A unicycle for operation in water for remaining buoyant and propelling a user forward through water comprising, in combination:

a frame having buoyancy pads disposed therein, the frame having a yoke portion, the yoke portion having a pair of extending arms;

a hollow wheel having an intake opening formed through a central portion thereof, the hollow wheel having an impeller mechanism disposed therein, the hollow wheel having an exhaust pipe tangentially integral therewith extending outwardly therefrom, the hollow wheel positioned between the pair of extending arms of the yoke portion;

a pair of pedals rotatably coupling the hollow wheel to the pair of extending arms of the yoke through the intake opening;

a foam padded seat portion secured to the frame.

3. The unicycle as described in claim 1 wherein the impeller means further defining a plurality of curved blades biased towards the exhaust pipe.

4. The unicycle as described in claim 2 and further including hook and loop straps secured to the foam padded seat portion for securement around a user's lap when seated on the foam padded seat portion.

5. The unicycle as described in claim 2 and further including hook and loop straps secured to each of the pair of pedals for securement around a user's feet.

6. The unicycle as described in claim 2 and further including hook and loop straps secured to the frame for securement around a user's chest.

* * * * *